US005664333A

United States Patent [19]

Hardman

[11] Patent Number: 5,664,333

[45] Date of Patent: Sep. 9, 1997

[54] HAND HELD AND BASE OPERATED CAN OPENER COMBINATION

[76] Inventor: Tonia C. Hardman, 2980 S. Courtney Dr., Salt Lake City, Utah 84120

[21] Appl. No.: 665,252

[22] Filed: Jun. 17, 1996

[51] Int. Cl.[6] ..... B67B 7/60

[52] U.S. Cl. ..... 30/423; 30/400; 30/416

[58] Field of Search ..... 30/400–444, 296.1, 30/296.4, 277.4, 273

[56] References Cited

U.S. PATENT DOCUMENTS

| | | | |
|---|---|---|---|
| D. 292,912 | 11/1987 | Muller et al. | D13/6 |
| D. 301,828 | 6/1989 | Wong | D8/36 |
| D. 362,165 | 9/1995 | Wheeler | D8/36 |
| 4,521,965 | 6/1985 | Walker | 30/410 |
| 4,561,182 | 12/1985 | Yamamoto et al. | 30/400 X |
| 4,622,749 | 11/1986 | Inagki | 30/421 |
| 4,663,849 | 5/1987 | Nickelson | 30/298.4 |
| 4,702,007 | 10/1987 | Nomura et al. | 30/423 |
| 4,734,985 | 4/1988 | Ozaki | 30/404 |
| 5,239,757 | 8/1993 | Weaber | 30/401 |

*Primary Examiner*—Douglas D. Watts

*Attorney, Agent, or Firm*—John D. Gugliotta; David L. Volk

[57] ABSTRACT

A hand held and base operated can opener combination that can be both operated in a base mounted counter top configuration and a portable hand held configuration is disclosed. Consisting of a base unit with an integral power supply and battery charger, it is physically connected to a head unit containing rechargeable batteries, an electric motor, a conventional can opening mechanism, a manual can opening means, and associated electrical control circuitry. The invention may be utilized to open cans on a kitchen counter top by attaching the can and pressing down on the top lever section of the unit, in the same manner as one would use a conventional electric can opener. The invention may also be operated in a portable hand held configuration, in the same manner as one would use a manual hand operated can opener, except with the added convenience of pressing a switch to operate an electric motor in lieu of a hand crank.

8 Claims, 4 Drawing Sheets

HAND HELD AND BASE OPERATED CAN OPENER COMBINATION

RELATED APPLICATIONS AND DISCLOSURE DOCUMENTS

This application is a continuation of the invention described in the Disclosure Document No. 386,938, dated Dec. 18, 1995.

BACKGROUND OF THE INVENTION

1. Field of the Invention

The present invention relates generally to electric can openers and, more particularly, to an electric can opener that can be both operated in a base mounted counter top configuration and a portable hand held configuration.

2. Description of the Related Art

In the related art, many can opening devices are known. For example, in U.S. Pat. No. 5,239,757, issued in the name of Weaber, a portable can opener apparatus is disclosed which is battery powered. And, in U.S. Design Patent No. 292,912, issued in the name of Muller et al., a charger base for a battery operated can opener is disclosed.

Although many improvements in battery operated appliances have allowed for many types of battery operated can openers. However, many situations still require the use of a conventional, counter mounted electric can opener. Consequently, a need has been felt for providing an apparatus and which is capable of providing the benefits of both types of systems.

SUMMARY OF THE INVENTION

It is therefore an object of the present invention to provide an improved hand held and base operated can opener combination.

It is another object of the present invention to provide an improved hand held and base operated can opener combination that allows for the opening of cans while operated in a counter top base unit configuration.

It is yet another object of the present invention to provide an improved hand held and base operated can opener combination that allows for the opening of cans while operated in a portable hand-held unit configuration.

It is another object of the present invention to provide an improved hand held and base operated can opener combination that provides for the automatic recharging of the portable configuration operating batteries while stored in the counter top base unit configuration.

It is yet another object of the present invention to provide an improved hand held and base operated can opener combination that allows for the manual opening of cans when both counter top base unit configuration and portable hand held unit configuration power supplies are not available.

It is a feature of the present invention to provide an improved hand held and base operated can opener combination that is easy to utilize by the common user.

Briefly described according to one embodiment of the present invention, a hand held and base operated can opener combination that can be both operated in a base mounted counter top configuration and a portable hand held configuration is disclosed. Consisting of a base unit with an integral power supply and battery charger, it is physically connected to a head unit containing rechargeable batteries, an electric motor, a conventional can opening mechanism, a manual can opening means, and associated electrical control circuitry. The invention may be utilized to open cans on a kitchen counter top by attaching the can and pressing down on the top lever section of the unit, in the same manner as one would use a conventional electric can opener. The invention may also be operated in a portable hand held configuration, in the same manner as one would use a manual hand operated can opener, except with the added convenience of pressing a switch to operate an electric motor in lieu of a hand crank.

An advantage of the present invention is that it can be utilized on large, oversized cans that are difficult to open with conventional electric can openers.

Another advantage of the present invention is that in the case of small kitchens with reduced counter top space, it can be stored in a remote location, such as inside a kitchen cabinet, and still retain the ability to open cans by simply removing the head unit and utilizing the invention in the portable hand held configuration.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
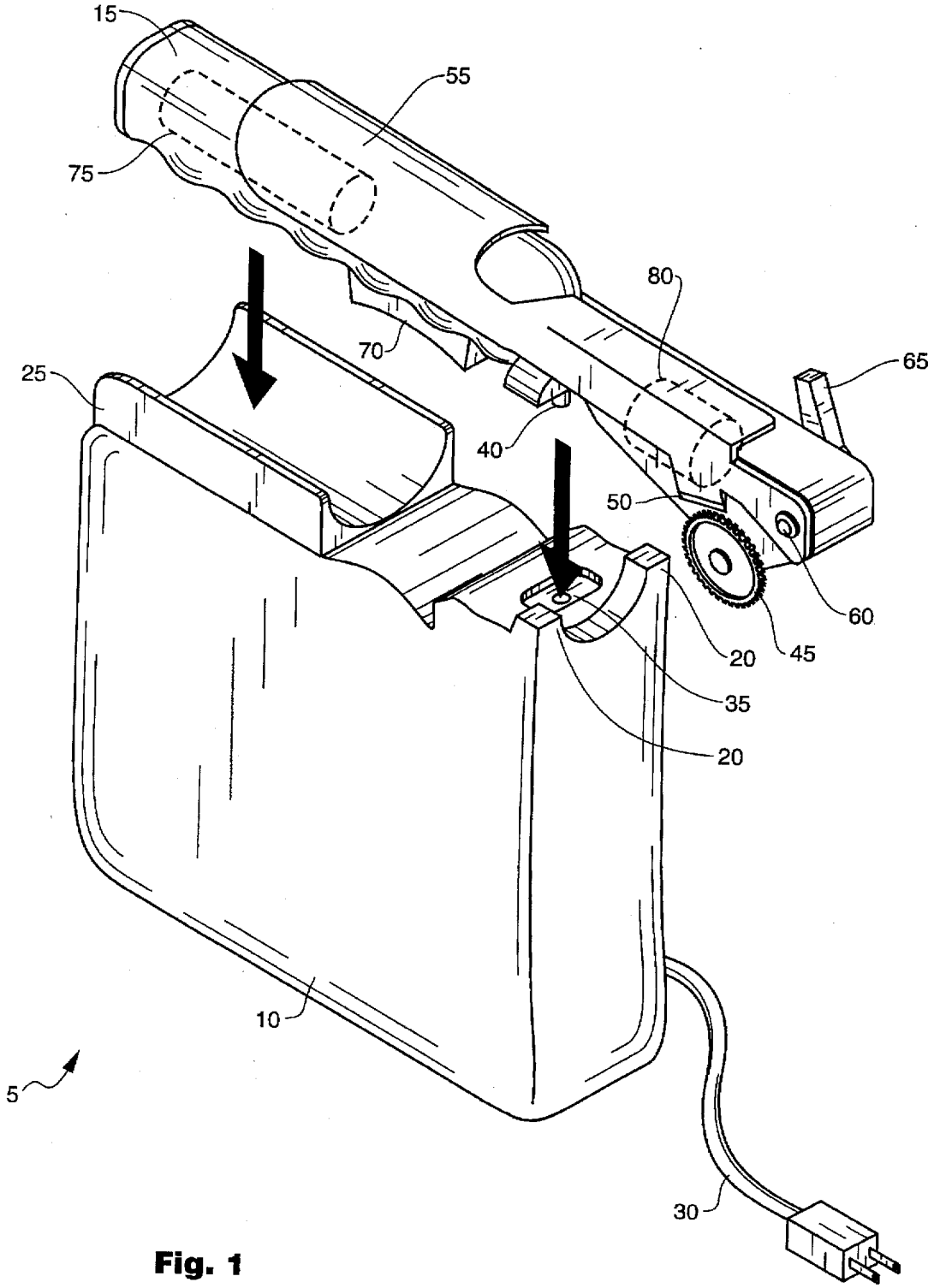
FIG. 1 is a perspective view of the present invention in accordance with a preferred embodiment of the present invention.

Referring now to FIG. 1, a perspective view of the hand held and base operated can opener combination 5 in accordance with a preferred embodiment of the present invention is disclosed. A base unit 10 is provided in which an operating head 15 is attached via a locking mechanism comprising locking clips 20 and a handle cradle 25. Attached to the base unit 10 is a power cord 30, whose function will be described in greater detail below. Located on the upper, topmost horizontal surface of the base unit 10 is a female two pole electrical contact 35. The female two pole electrical contact 35 connects to a male two pole electrical contact 40 located on the operating head 15. The female two pole electrical contact 35 and the male two pole electrical contact 40 are used to transfer electrical energy from the base unit 10 to the operating head 15 when the operating head 15 is in a storage position attached to the base unit 10. Located at one end of the operating head 15 is a can gripper wheel 45 which operates in a conventional manner providing the rotational motion which turns the can against a can seal cutter knife 50. The can seal cutter knife 50 is part of a movable handle assembly 55 which pivots around a pivoting means 60, such as a pin or screw which allows for movement of the movable handle assembly 55 with minimal friction. The can seal cutter knife 50 also acts as the initial can seal puncture mechanism when the movable handle assembly 55 and associated can seal cutter knife 50 is first brought into contact with the can. Located on the end rearward side of the operating head 15 is a manual crank 65 which allow for the manual turning of the can gripper wheel 45 as would be found on a conventional can opener for use when electrical power is not available. Located on the middle bottom side of the operating head 15 is a trigger switch 70. The trigger switch 70 serves as the means to control electrical power from a rechargeable battery pack 75 to a motor 80. Both the rechargeable battery pack 75 and the motor 80 are located in the interior space of the operating head 15 and are represented by dashed lines in this figure. The physical activation of the trigger switch 70 is accomplished by different means and will be described in greater detail below.

Figure 2:
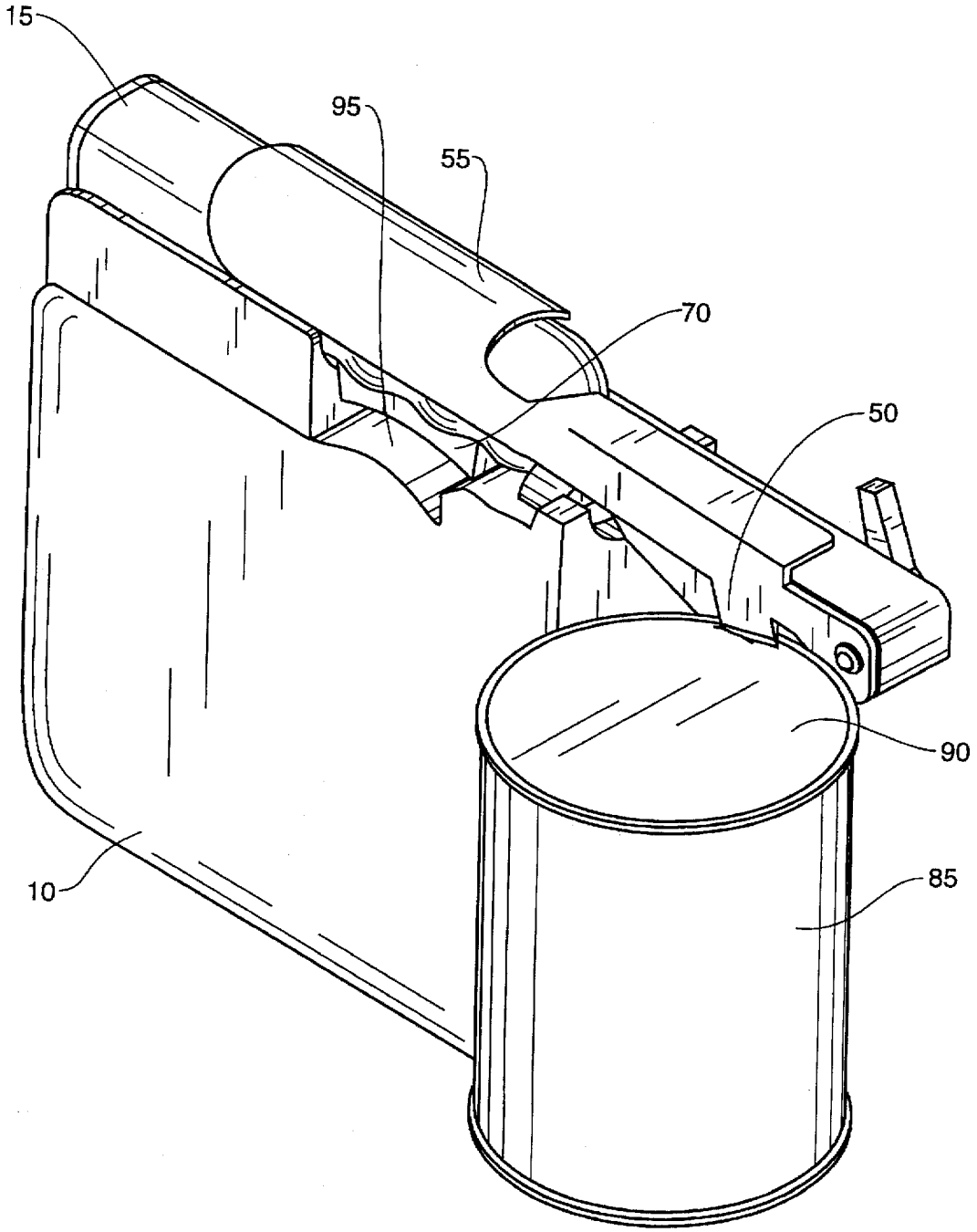
FIG. 2 is a perspective view of the present invention shown in counter top, base unit configuration.

Referring next to FIG. 2, a perspective view of the present invention is disclosed in a counter top, base unit configuration. A can 85 is installed upon the can gripper wheel 45 (not shown in this fig.) and the can seal cutter knife 50 in a conventional manner. By pressing down on the movable handle assembly 55, an initial puncture of the can 85 and subsequent removal of a can lid 90 is performed. This action is accomplished in one motion defined by the initial puncture and subsequent down pressure of the movable handle assembly 55 which activates the trigger switch 70 by pressure against an activating notch 95 located on the top of the base unit 10. This pressure is permitted by the handle cradle 25 which allows for a minor movement against a pivot point defined by the locking clips 20. With the electrical circuit now closed, power is applied to the motor 80 (not shown in this fig.) and rotational energy is imparted to the can 85 via the can gripper wheel 45 (not shown in this fig) forcing it against the can seal cutter knife 50 and causing subsequent removal of the can lid 90.

Figure 3:
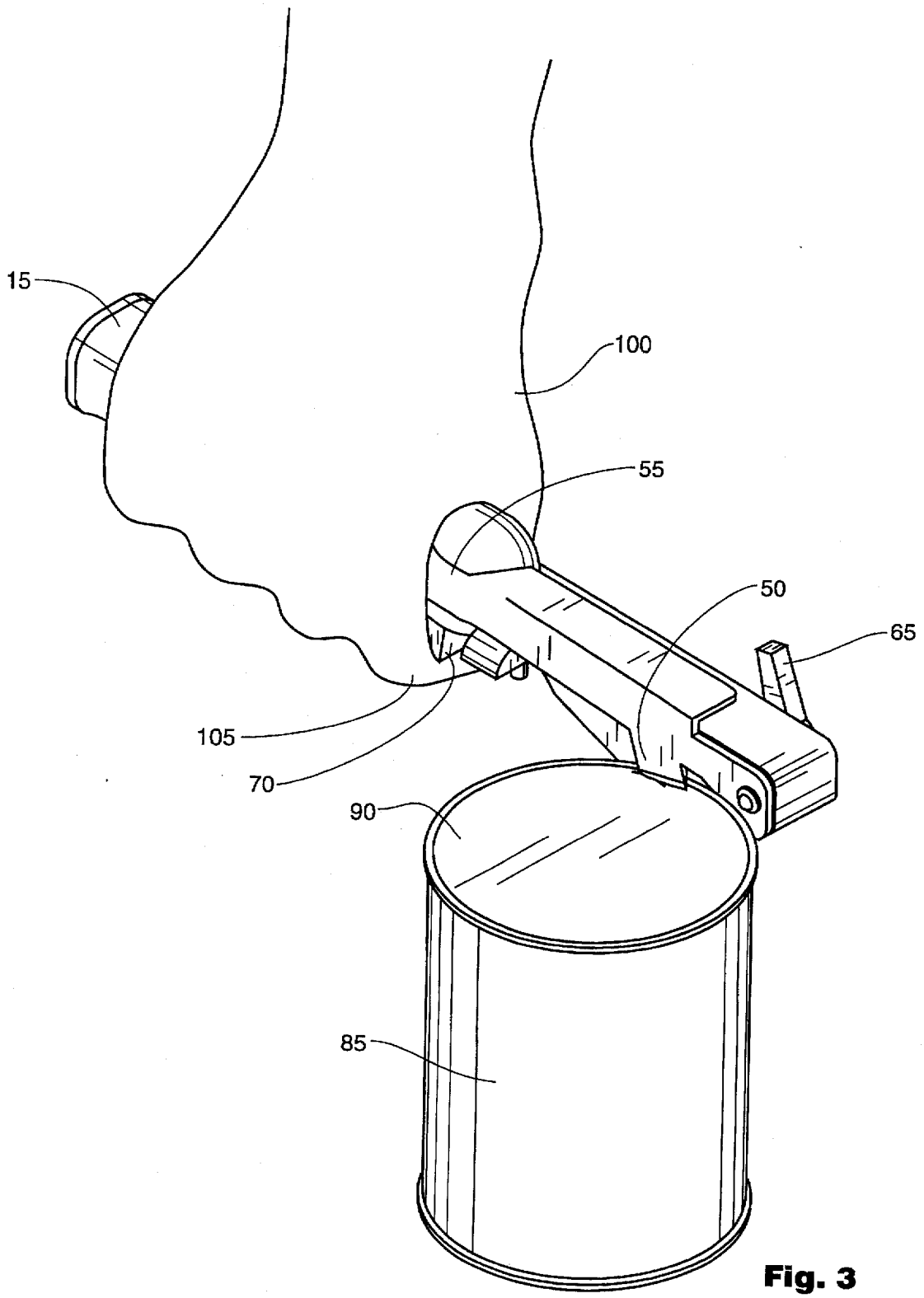
FIG. 3 is a perspective view of the present invention shown in portable, hand held configuration.

Now referring to FIG. 3, a perspective view of the present invention is disclosed in a portable, hand held configuration. The operating head 15 is now held by a user's hand 100 as shown. The can lid 90 is removed from the can 85 by downward pressure and subsequent rotation against the can seal cutter knife 50 in the same manner as described in FIG. 2. The trigger switch 70 however is now activated by a forefinger 105 as indicated, in lieu of the activating notch 95 as shown in FIG. 2. The manual crank 65 may also be used to impart rotational energy to the can 85 in instances where the rechargeable battery pack 75 (not shown in this FIG.) is depleted or the user wishes to open the can 85 manually.

Figure 4:
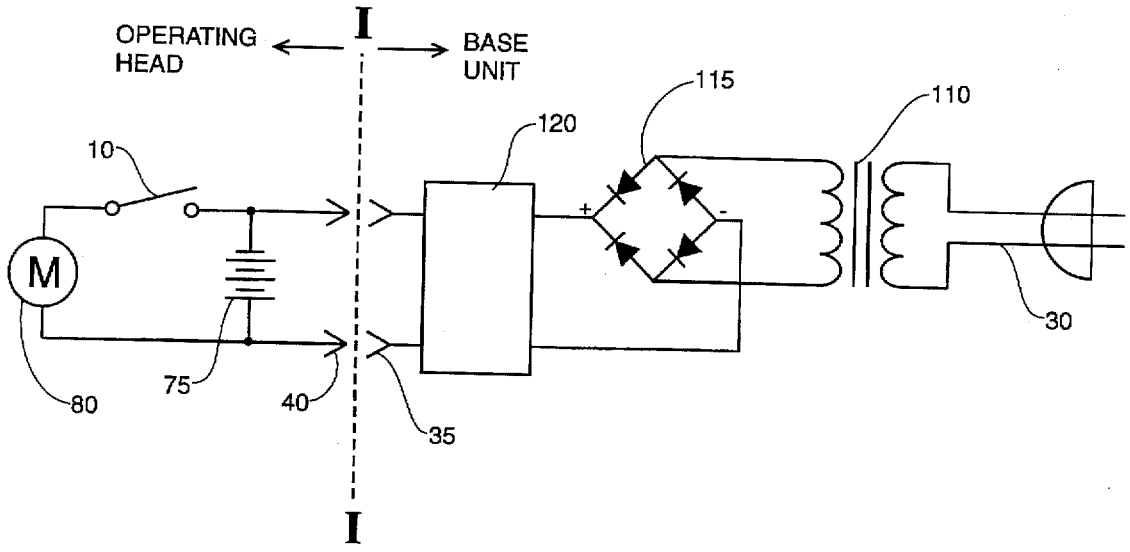
FIG. 4 is a schematic diagram of the electrical components utilized in the present invention.

Referring finally to FIG. 4, a schematic diagram of the electrical components as utilized in the present invention is disclosed. Electrical components located on or in the base unit 10 are indicated to the right of the dashed line I—I and electrical components located on or in the operating head 15 are indicated to the left of the dashed line I—I. The power cord 30 provides standard alternating current power to a voltage reducing transformer 110. The alternating current output from the voltage reducing transformer 110 is then connected to a rectifying circuit 115 which converts the alternating current to a direct current suitable for use by regulating circuits. The direct current output of the rectifying circuit 115 is then provided to a battery charging and regulation circuit 120 which further processes the direct current energy to allow for battery charging purposes. This electrical power then leaves the base unit 10 (not shown in this FIG.) via the female two pole electrical contact 35. The same electrical energy is then received by the male two pole electrical contact 40 located on the operating head 15 (not shown in this FIG.) and channeled directly to the rechargeable battery pack 75 in a continuous manner. Electrical power across the rechargeable battery pack 75 is subsequently controlled by the trigger switch 70 for use by the motor 80.

2. Operation of the Preferred Embodiment

In operation, the present invention can be utilized by the common user in a simple and effortless manner. To use the present invention with its preferred embodiment can best be described in conjunction with the perspective view of FIG. 1, the perspective view of the present invention shown in a counter top, base unit configuration of FIG. 2, the perspective view of the present invention shown in portable, hand held configuration of FIG. 3, and the schematic diagram of the electrical components utilized in the present invention of FIG. 4.

An individual could utilize the hand held and base operated can opener combination 5 in one of two manners. First, in the counter top, base unit configuration of FIG. 2, the can 85 is attached to the operating head 15 which is installed in its base unit 10. Pressure applied to the movable handle assembly 55 allows for an initial puncture of the can 85 and the same pressure then allows for activation of the trigger switch 70 against the activating notch 95 located on the base unit 10. Upon activation of the trigger switch 70 rotational action of the motor 80 allows for opening of the can 85 and removal of the can lid 90. Upon completion of one rotation of the can, the user simply releases the movable handle assembly 55 which provides for the subsequent deactivation of the motor 80, which allows the user to remove the can 85.

Secondly, the user could utilize the hand held and base operated can opener combination 5 in a portable hand held configuration as disclosed by FIG. 3. The can 85 is attached to the operating head 15 which is held in the voltage reducing transformer 110 Pressure applied by the voltage reducing transformer 110 to the movable handle assembly 55, against the operating head 15, allows for an initial puncture of the can 85. Activation of the trigger switch 70 by the forefinger 105 of the user then allows for the rotational action of the motor 80 and subsequent opening of the can 85 and removal of the can lid 90. Upon completion of one rotation of the can, the user simply releases the trigger switch 70 which provides for the subsequent deactivation of the motor 80, which allows the user to remove the can 85. Removal of the can lid 90 from the can 85 could also be accomplished by the utilization of the manual crank 65 in lieu of the rotational energy of the motor 80. This would be utilized in instances where the energy level of the rechargeable battery pack 75 is depleted or in instances where the user desires to open the can 85 manually.

The foregoing description is included to illustrate the operation of the preferred embodiment and is not meant to limit the scope of the invention. The scope of the invention is to be limited only by the following claims.

What is claimed is:

1. A hand held or base operated can opener combination comprising:

a base unit having a female two pole electrical contact located on the upper, topmost horizontal surface of said base unit;

a power cord attached to said base unit;

a battery operating head for opening metal cans having a male two pole electrical contact located on the operating head for connecting to said female two pole electrical contact;

a rechargeable battery pack located in the interior space of the operating head;

a motor located in the interior space of the operating head; and a locking mechanism for attaching said operating head to said base unit comprising locking clips and a handle cradle.

2. The hand held or base Operated can opener combination as described in claim 1, wherein:

said female two pole electrical contact and said male two pole electrical contact are used to transfer electrical energy from said base unit to said operating head when said operating head is in a storage position attached to said base unit.

3. The hand held or base operated can opener combination as described in claim 1, wherein said operating head comprises:

a can seal cutter knife; and a can gripper wheel located at one end of said operating head for operating in a conventional manner by providing the rotational motion which turns the can against said can seal cutter knife.

4. The hand held or base operated can opener combination as described in claim 3, wherein said can seal cutter knife is part of a movable handle assembly which pivots around a pivoting means for allowing for movement of said movable handle assembly with minimal friction.

5. The hand held or base operated can opener combination as described in claim 4, wherein:

said can seal cutter knife acts as the initial can seal puncture mechanism when said movable handle assembly and associated can seal cutter knife are first brought into contact with a can.

6. The hand held or base operated can opener combination as described in claim 5, further comprising:

a manual crank opener for use when electrical power is not available, said crank opener located on the end rearward side of the operating head for allowing for the manual turning of said can gripper wheel.

7. The hand held or base operated can opener combination as described in claim 1, further comprising:

a trigger switch located on the middle bottom side of said operating head for providing a means to control electrical power from said rechargeable battery pack to said motor.

8. A hand held and base operated can opener combination that can be both operated in a base mounted counter top configuration and a portable hand held configuration comprising:

a base unit with an integral power supply and battery charger; and a head unit containing rechargeable batteries, an electric motor, a can opening mechanism, a manual can opening means, and associated electrical control circuitry, said head unit removably connected to said base unit.

* * * * *